US008287152B2

(12) United States Patent
Gill

(10) Patent No.: US 8,287,152 B2
(45) Date of Patent: Oct. 16, 2012

(54) LIGHTING APPARATUS USING LIGHT EMITTING DIODE

(75) Inventor: Jason Jae Gill, Omaha, NE (US)

(73) Assignee: Amoluxe Co., Ltd., Gyeonggi-do (KR)

( * ) Notice: Subject to any disclaimer, the term of this patent is extended or adjusted under 35 U.S.C. 154(b) by 37 days.

(21) Appl. No.: 12/933,917

(22) PCT Filed: Mar. 31, 2008

(86) PCT No.: PCT/KR2008/001782

§ 371 (c)(1),
(2), (4) Date: Sep. 22, 2010

(87) PCT Pub. No.: WO2009/119929

PCT Pub. Date: Oct. 1, 2009

(65) Prior Publication Data

US 2011/0026253 A1 Feb. 3, 2011

(30) Foreign Application Priority Data

Mar. 24, 2008 (KR) ..... 10-2008-0026980

(51) Int. Cl.
*F21S 8/08* (2006.01)
*F21V 29/00* (2006.01)

(52) U.S. Cl. ..... 362/249.02; 362/294; 362/431

(58) Field of Classification Search ..... 362/294, 362/373, 431, 249.02, 249.06
See application file for complete search history.

(56) References Cited

U.S. PATENT DOCUMENTS

| | | | | |
|---|---|---|---|---|
| 6,682,211 | B2 | 1/2004 | English et al. | |
| 6,981,784 | B2 | 1/2006 | Dubuc | |
| 7,329,030 | B1 * | 2/2008 | Wang | 362/373 |
| 7,513,639 | B2 * | 4/2009 | Wang | 362/218 |
| 7,513,659 | B2 * | 4/2009 | Vukosic et al. | 362/373 |
| 7,593,229 | B2 * | 9/2009 | Shuy | 361/705 |
| 7,628,508 | B2 * | 12/2009 | Kita et al. | 362/231 |
| 7,631,985 | B1 * | 12/2009 | Knoble et al. | 362/225 |
| 7,726,851 | B2 * | 6/2010 | Shuai et al. | 362/373 |
| 7,766,513 | B2 * | 8/2010 | Zhang et al. | 362/294 |
| 8,025,428 | B2 * | 9/2011 | Duguay et al. | 362/311.02 |
| 2008/0080188 | A1 * | 4/2008 | Wang | 362/294 |

FOREIGN PATENT DOCUMENTS

| | | | |
|---|---|---|---|
| JP | 09-147089 | A | 6/1997 |
| JP | 2005-181290 | A | 7/2005 |
| JP | 2006-156074 | A | 6/2006 |
| JP | 2007-173177 | A | 7/2007 |
| JP | 2007-187914 | A | 7/2007 |
| KR | 1020010012585 | A | 2/2001 |

OTHER PUBLICATIONS

International Search Report: PCT/KR2008/001782.

* cited by examiner

*Primary Examiner* — Peggy A. Neils
(74) *Attorney, Agent, or Firm* — Ladas & Parry LLP

(57) ABSTRACT

Disclosed is a light apparatus using light emitting diodes that includes: a base body member having a mounting surface on its one surface; a plurality of inclined block members each of which is mounted on the mounting surface of the base body member and has an inclined surface on one surface thereof; and light emitting diode module members that are mounted on the inclined surfaces of the inclined block members. According to the disclosure, it is possible to easily form various light distributions required for the lighting design by combining the inclined block members and the light emitting diode module members that are mounted on the mounting surfaces of the base body member, and various light distributions can be formed, which makes it possible to improve flexibility in the lighting design and to improve lighting efficiency for an object to be illuminated.

8 Claims, 19 Drawing Sheets

(a)

(b)

(a)

(b)

LIGHTING APPARATUS USING LIGHT EMITTING DIODE

TECHNICAL FIELD

The present invention relates to a lighting apparatus using light emitting diodes, and more particularly, to a lighting apparatus capable of forming various light distribution types using light emitting diodes as a light source.

BACKGROUND ART

Generally, lighting apparatuses, such as a street light and a floodlight, have been designed and manufactured to have a proper light distribution type so that they can efficiently light an object to be illuminated.

The lighting apparatus is designed such that a high pressure sodium lamp, a mercury vapor, a metal halide lamp, or a typical electric bulb, is used as a light source and light from the light source is reflected from a reflection plate to form a light distribution type suitable for an object to be illuminated.

In particular, a floodlight has been used widely in many fields of a building, an advertisement plate, a working site, a stadium, and a parking lot as well as an advertisement tower. In the floodlight, a reflection plate having a parabolic shape and a light source are provided inside a lamp housing.

The floodlight is designed to have a proper light distribution type in consideration of a distance from an object to be lighted and the lighting area of the object. The distance between a reflection plate and a light source, such as a high pressure sodium lamp, a mercury vapor or a metal halide is adjusted, or the angle and shape of the reflection plate are adjusted to form a desired light distribution.

Meanwhile, the lighting apparatus provided with the light source, such as a high pressure sodium lamp, a mercury vapor or a metal halide, is able to obtain various light distributions by adjusting the shape and angle of the reflection plate or reflector. However, the brightness and diffusion range of many kinds of lamps used as a light source, such as a high pressure mercury lamp, a fluorescent lamp, and a sodium lamp are fixed when the lamps are manufactured initially. Therefore, it is difficult for the user to arbitrarily adjust the brightness of the diffusion range. In addition, they have a short life span and high power consumption.

Recently, in consideration of the aforementioned drawbacks, a lighting apparatus has been proposed which uses LEDs (light emitting diodes) as a light source. With the development of technique, light emitting diodes with low power consumption and high brightness have been developed and come into widespread use.

However, the light emitting diode has a substantially permanent life span, as compared to the commonly used/conventional lamps according to the related art, and the brightness of light emitted from the light emitting diodes is determined by a combination of the light emitting diodes. When light distribution is formed by the reflecting plate, a light distribution area is small, and brightness is low. In addition, there are limitations in forming sufficient light distribution to effectively illuminate an object to be light.

Further, since it is difficult to effectively dissipate heat generated from a plurality of light emitting diodes, emission efficiency is lowered due to heat, which results in the damage of parts.

Furthermore, as shown in FIGS. 1 and 2, for example, most commonly used floodlights, which use light emitting diodes, are formed in a circular or rectangular shape, and includes a lamp housing member 1 having a flat lamp mounting surface on the inner surface and light emitting diode modules 2 which are provided on the flat lamp mounting surface la behind of the lamp housing member 1.

Therefore, the floodlight according to the related art has a problem in that it does not form various light distributions, and thus there are limitations in the installation position of the floodlight and objects to be illuminated.

DISCLOSURE OF INVENTION

Technical Problem

An object of the invention is to provide a lighting apparatus using light emitting diodes capable of increasing a light distribution area and brightness, and forming various light distributions effective for illuminating the road.

Another object of the invention is to provide a lighting apparatus using light emitting diodes capable of adjusting freely the mounting angles of light emitting diode modules to obtain a desired light distribution, and improving flexibility in the lighting design.

Technical Solution

According to an aspect of the invention, a lighting apparatus using light emitting diodes includes: a base body member having a mounting surface on its one surface; a plurality of inclined block members each of which is mounted on the mounting surface of the base body member and has an inclined surface on one surface thereof; and light emitting diode module members that are mounted on the inclined surfaces of the inclined block members.

Advantageous Effects

According to the above-mentioned aspect of the invention, it is possible to form various light distributions, improve flexibility in the lighting design, and improve lighting efficiency for an object to be illuminated.

DESCRIPTION OF REFERENCE NUMERALS IN THE DRAWINGS

Figure 1:
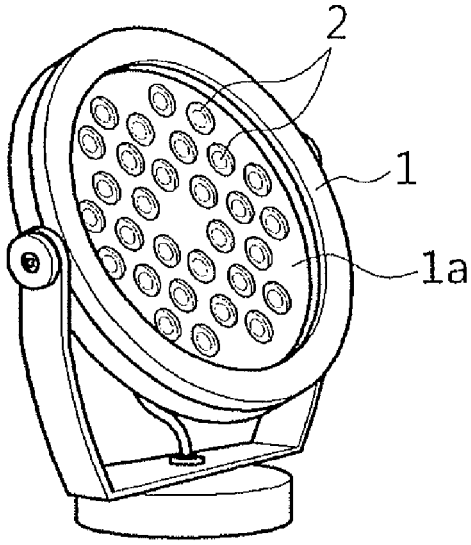
(PRIOR ART) FIG.1
FIGS. 1 and 2 are perspective views illustrating floodlights according to the related art.
Figure 2:
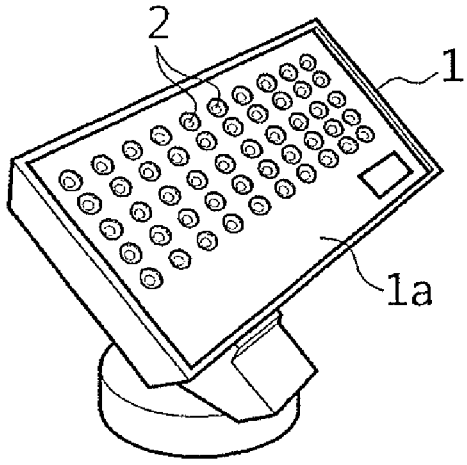
(PRIOR ART) FIG.2

10: base body member
11: mounting surface
12: side portion
20: inclined block member
30: light emitting diode module member
40: transparent panel member

BEST MODE FOR CARRYING OUT THE INVENTION

Hereinafter, the preferred embodiments of the invention will be described in detail referring to the attached drawings.

FIGS. 3 to 7 are perspective views illustrating various embodiments of the invention.

FIGS. 8 to 11 are cross-sectional views illustrating various examples of a base body member according to the invention.

Figure 12:
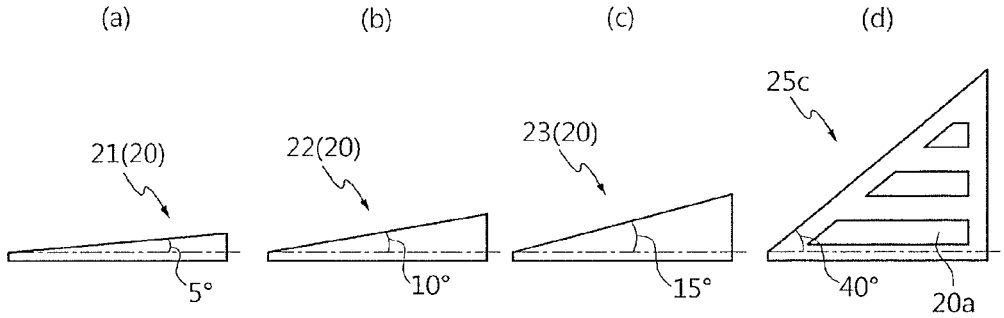
FIGS. 12 and 13 are side views illustrating examples of an inclined block member of the invention.
Figure 13:
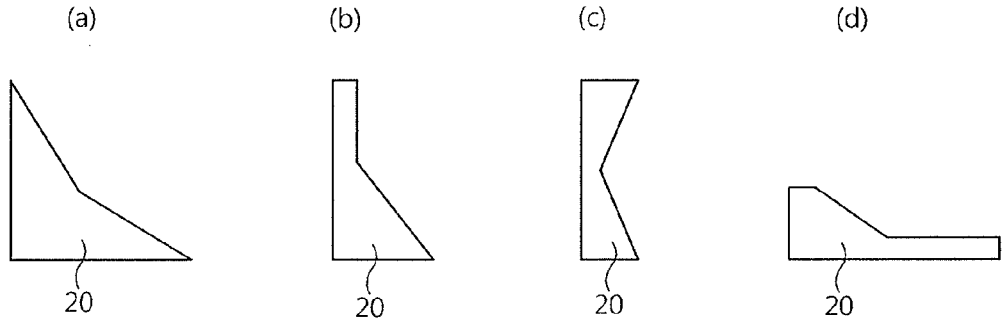

FIGS. 12 and 13 are side views illustrating examples of an inclined block member according to the invention. FIG. 12 is a view illustrating examples of the inclined block member provided with a single inclined surface, and FIG. 13 is a view illustrating examples of the inclined block member provided with a plurality of inclined surfaces.

Figure 14:
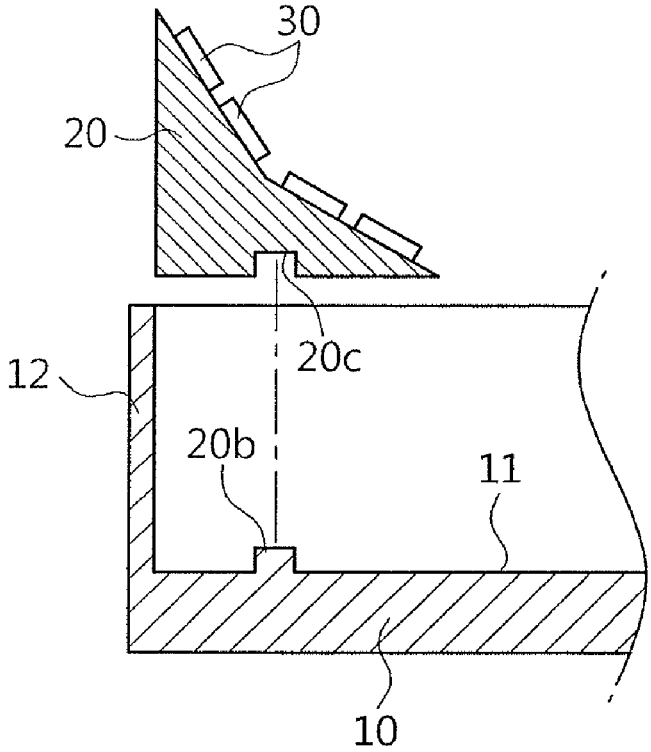
FIGS. 14 and 15 are enlarged cross-sectional views illustrating other examples of the inclined block member of the invention.
Figure 14:
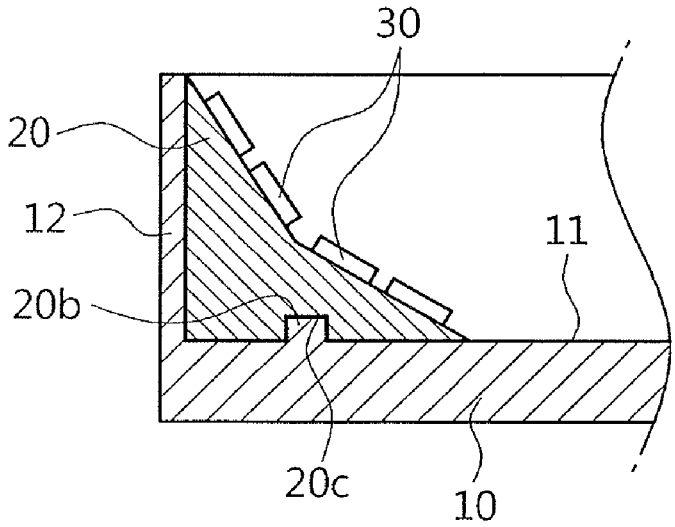
Figure 15:
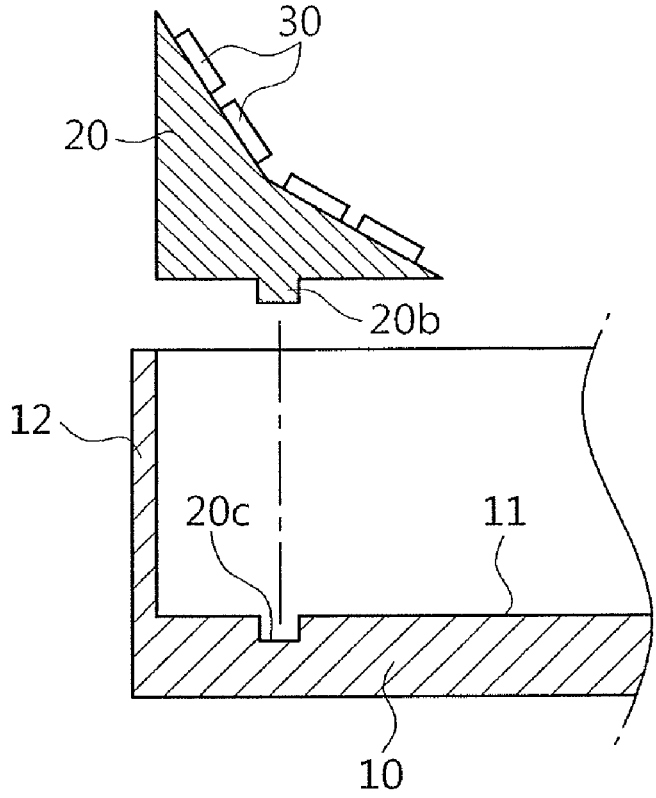
Figure 15:
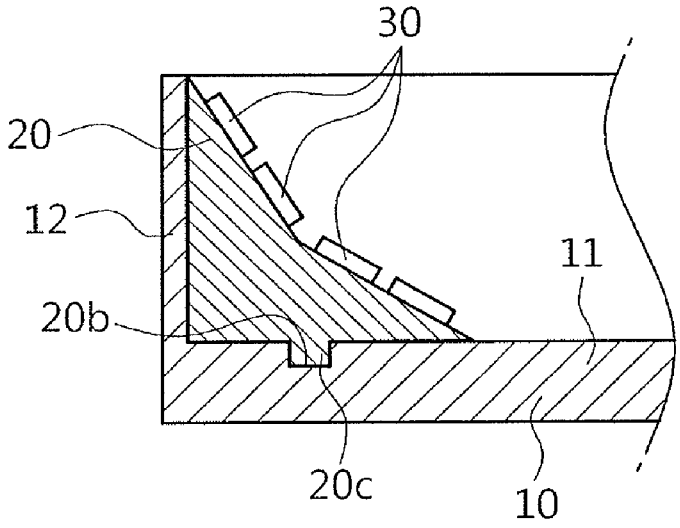

FIGS. 14 and 15 are enlarged cross-sectional views illustrating other examples of the inclined block member, and show examples of the inclined block member detachably connected to the base body member. FIG. 14 shows a connection protrusion on the mounting surface of a housing member, and FIG. 15 shows a connection protrusion on the lower surface of the inclined block member.

Figure 16:
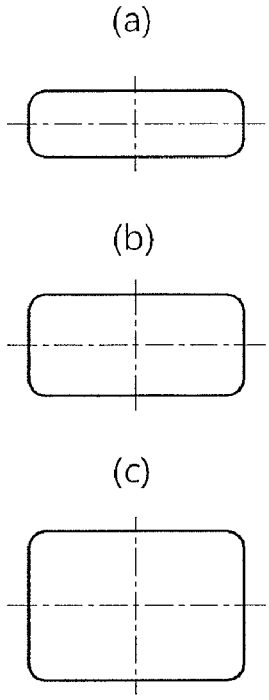
FIG. 16 is a schematic view illustrating a light distribution type typically used in a floodlight.

FIG. 16 is a schematic view illustrating light distribution types typically used in a floodlight, that is, a narrow light distribution type, an intermediate light distribution type, and a wide light distribution type.

Figure 17:
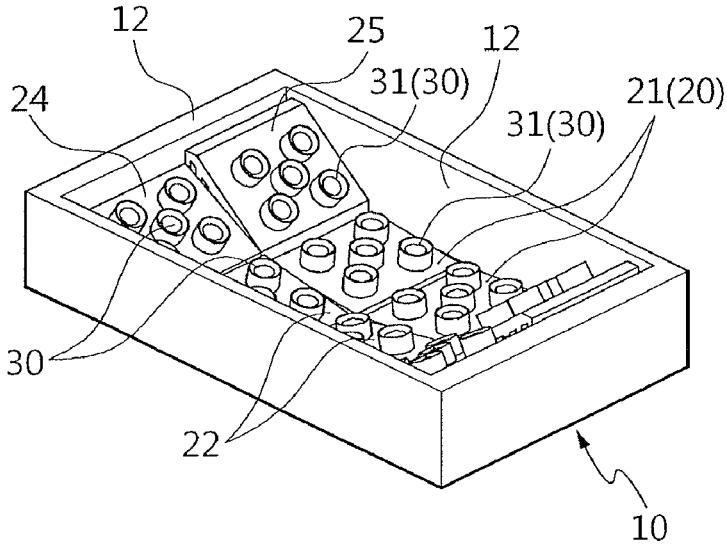
FIGS. 17 to 19 are views illustrating an example of a floodlight capable of forming a narrow light distribution.
Figure 18:
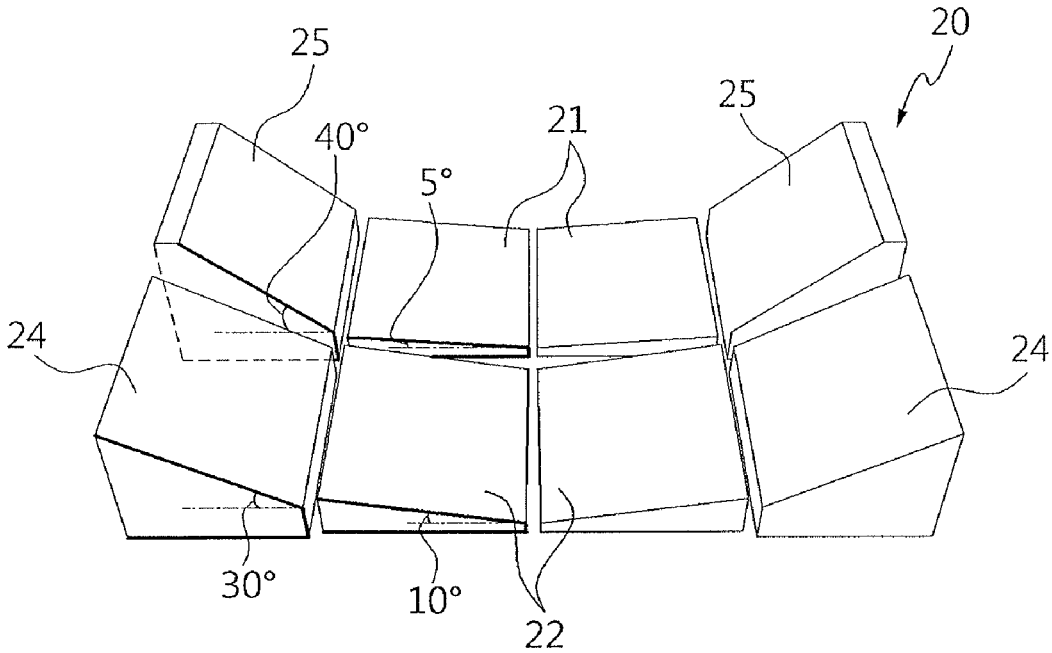
Figure 19:
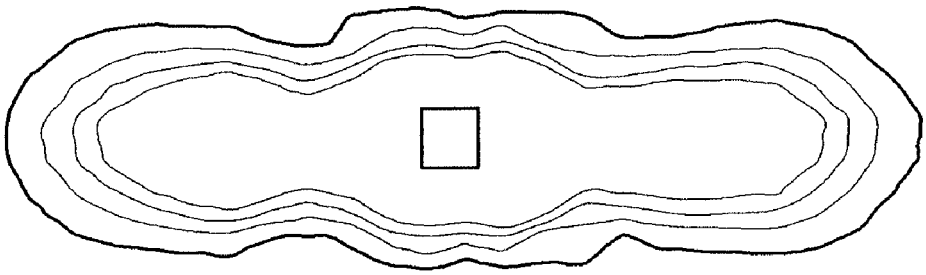

FIGS. 17 to 19 are views illustrating an example of a floodlight capable of forming the narrow light distribution as shown in FIG. 16, and show an example of a plurality of inclined members being mounted to the mounting surface of the base body member having a rectangular box shape.

Figure 20:
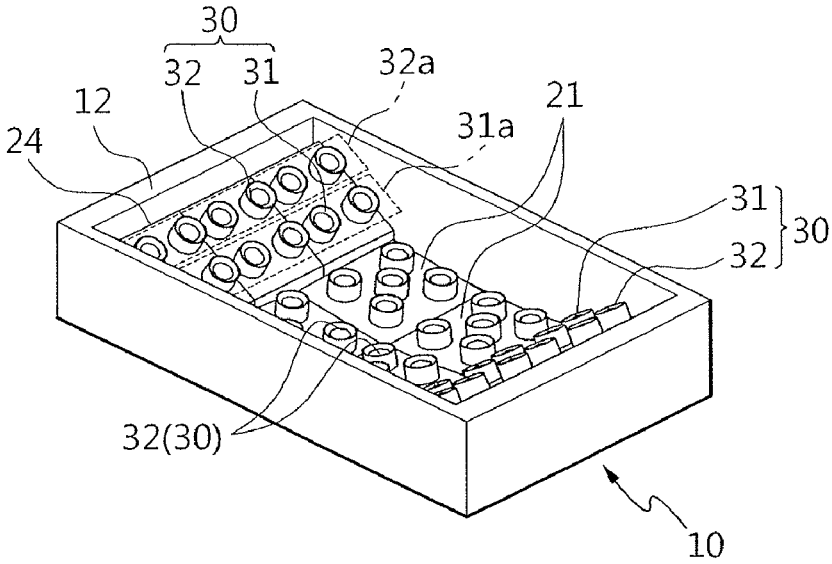
FIGS. 20 to 22 are views illustrating another example of a floodlight capable of forming an intermediate light distribution.
Figure 21:
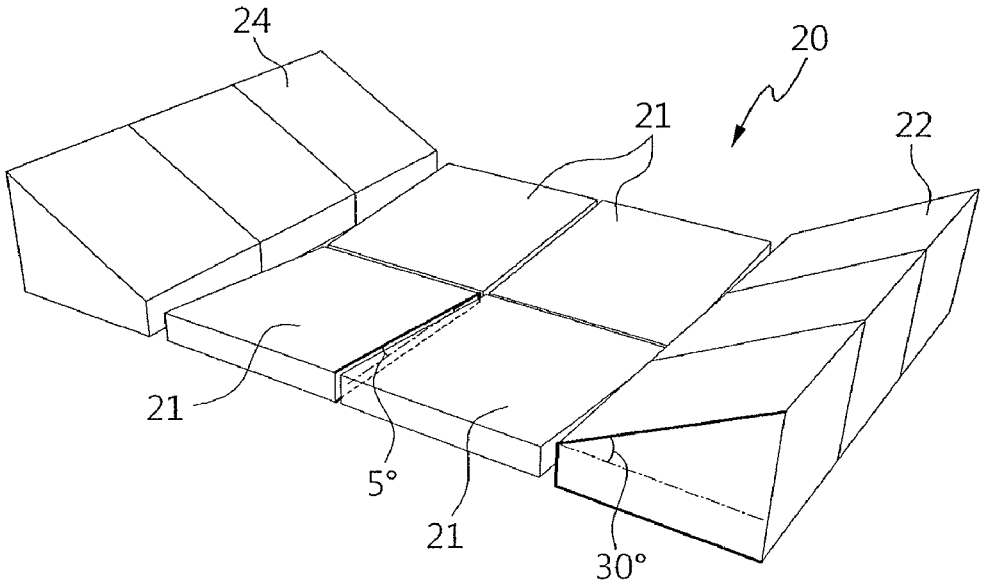
Figure 22:
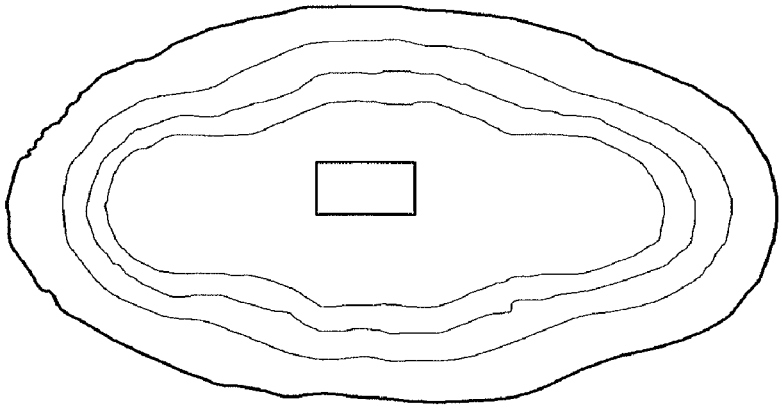

FIGS. 20 to 22 are views illustrating an example of a floodlight capable of forming the intermediate light distribution type as shown in FIG. 16, and show an example of a plurality of inclined members being mounted to the mounting surface of the base body member having a rectangular box shape.

Figure 23:
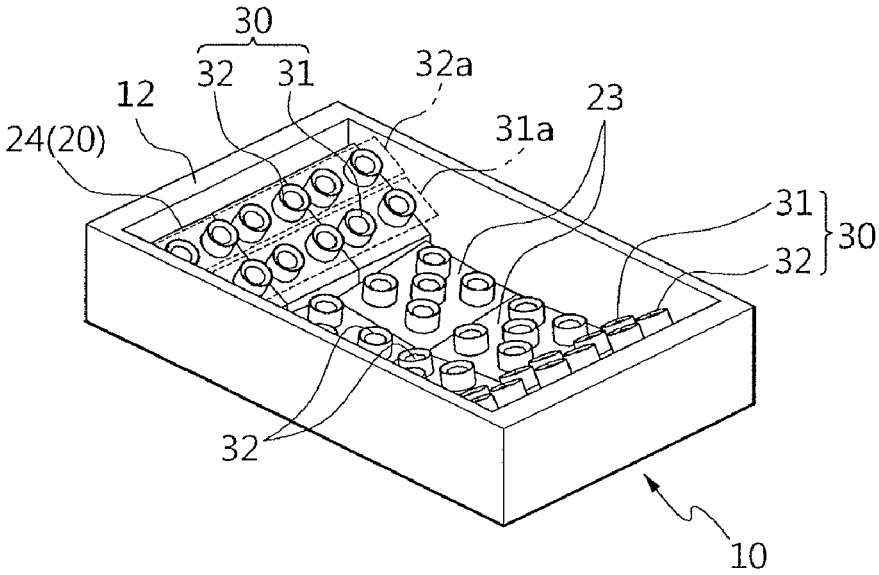
FIGS. 23 to 25 are views illustrating still another example of a floodlight capable of forming a wide light distribution.
Figure 24:
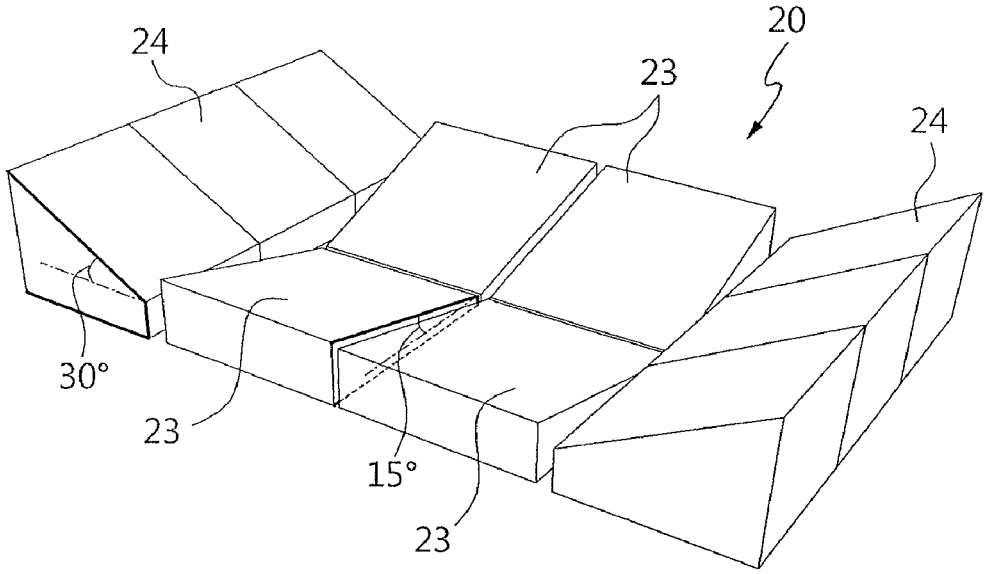
Figure 25:
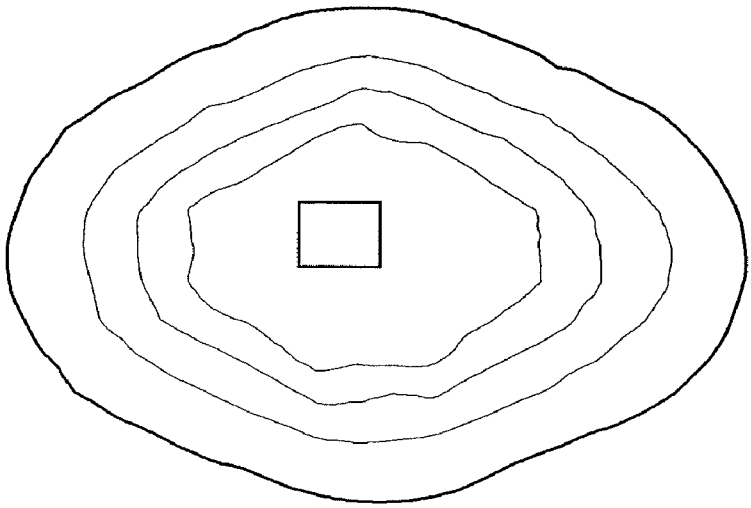

FIGS. 23 to 25 views illustrating an example of a floodlight capable of forming the wide light distribution type as shown in FIG. 16, and show an example of a plurality of inclined members being mounted to the mounting surface of the base body member having a rectangular box shape.

Figure 26:
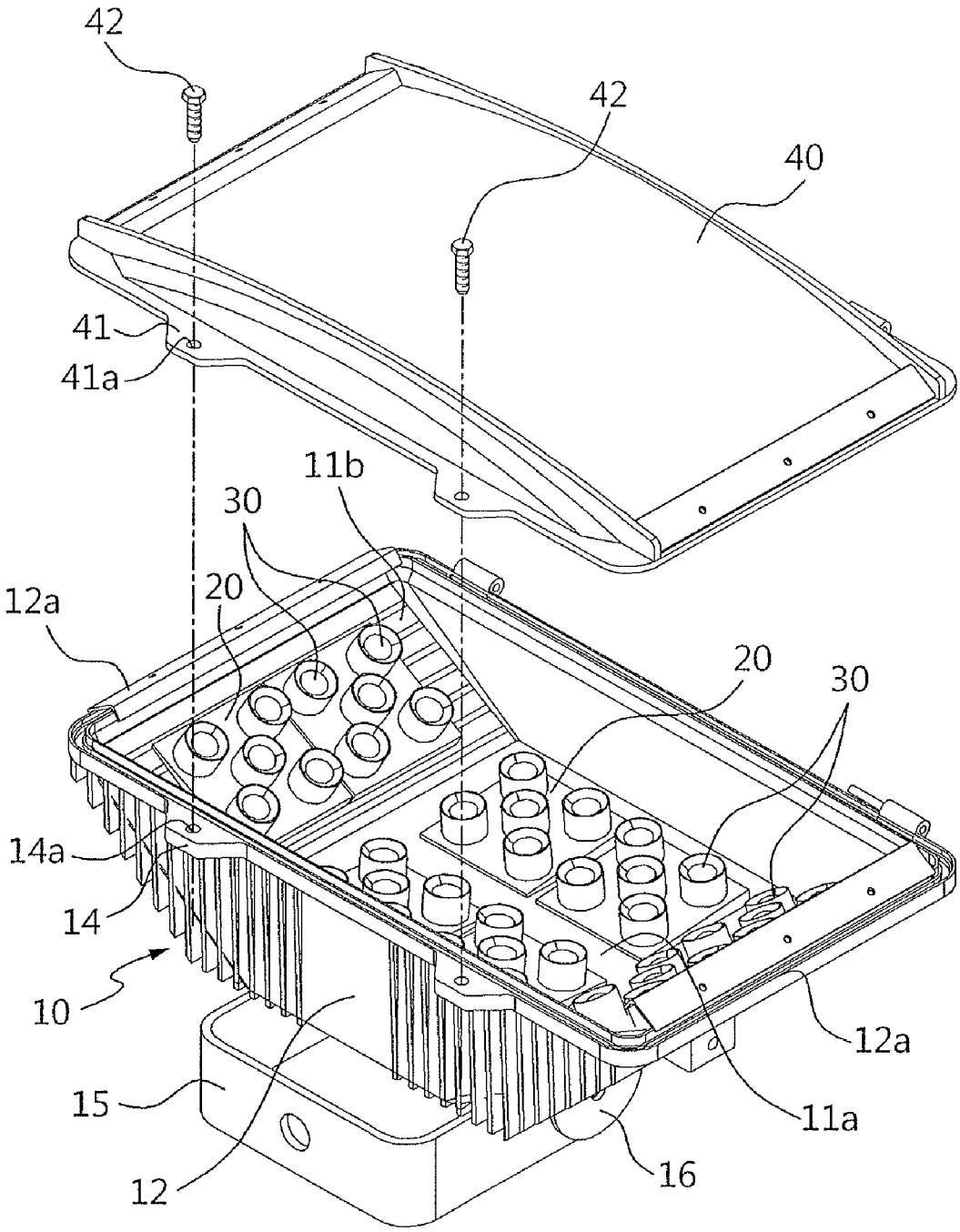
FIGS. 26 and 27 are perspective views illustrating another floodlight according to the invention.
Figure 27:
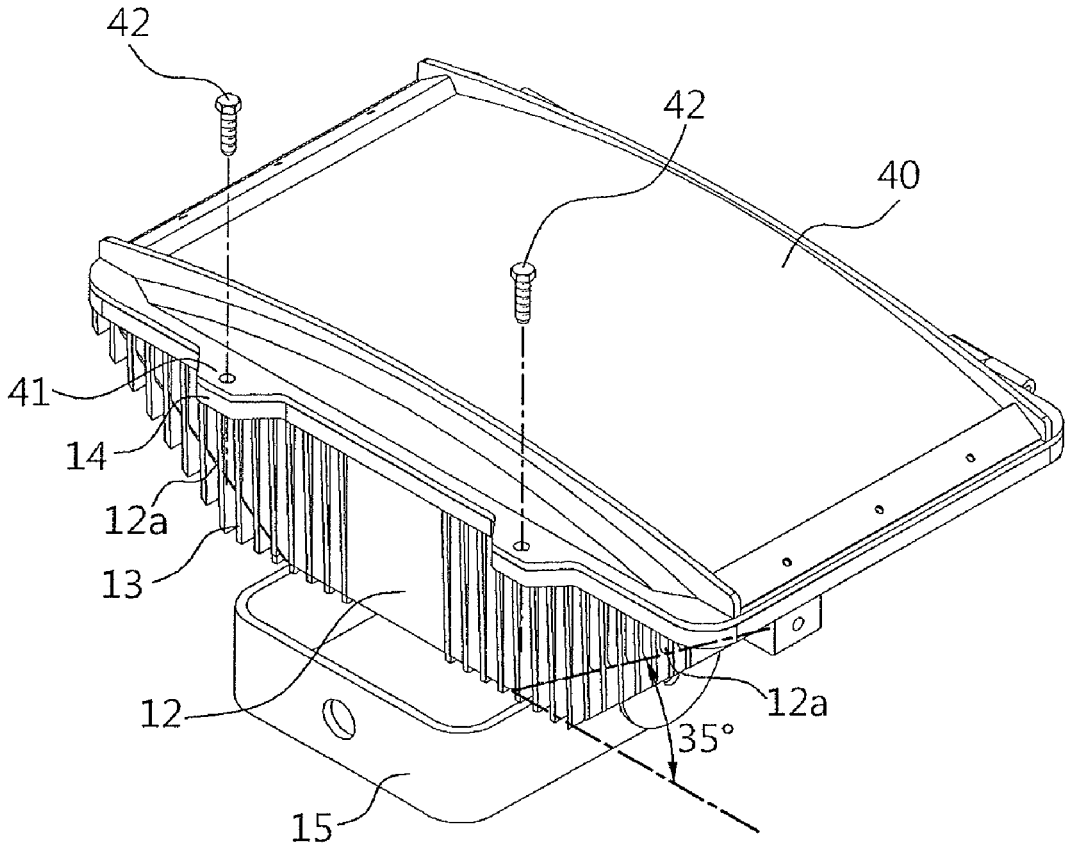

FIGS. 26 and 27 are perspective views of another floodlight included in the invention. FIG. 26 is an exploded perspective view, and FIG. 27 is an assembled view.

Figure 28:
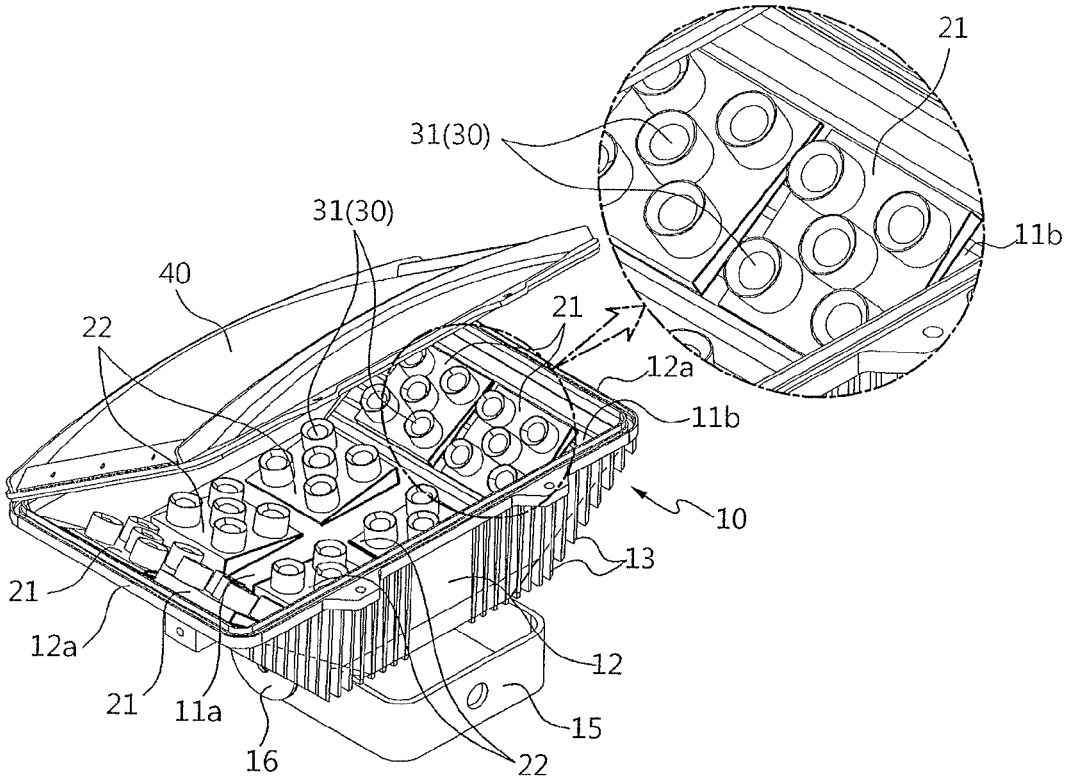
FIGS. 28 and 29 are views illustrating an example of the floodlight shown in FIGS. 26 and 27.
Figure 29:
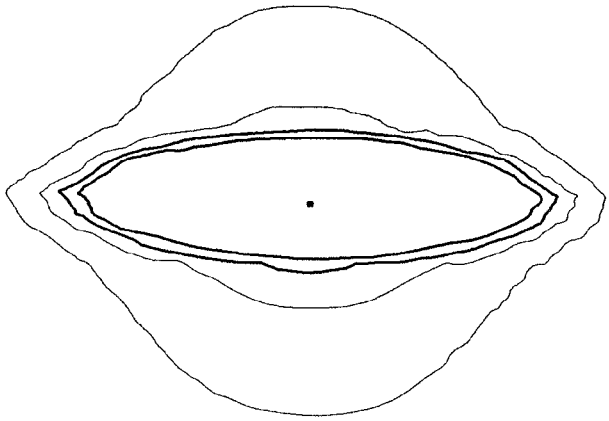

FIGS. 28 and 29 are views illustrating an example of the floodlight shown in FIGS. 26 and 27, and show an example capable of forming the narrow light distribution type shown in FIG. 16.

Figure 30:
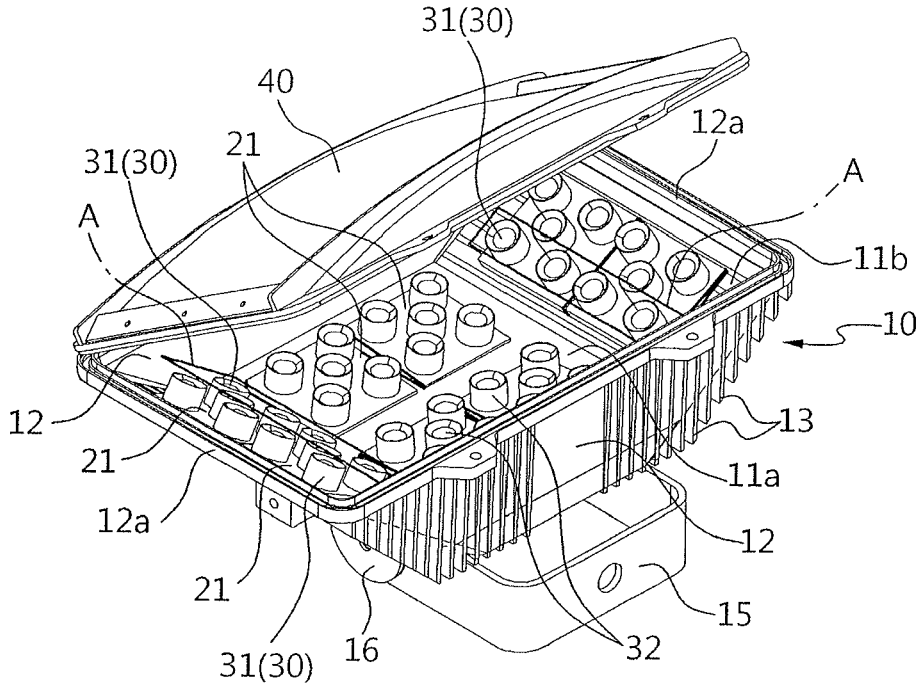
FIGS. 30 and 31 are views illustrating another example of the floodlight shown FIGS. 26 and 27.
Figure 31:
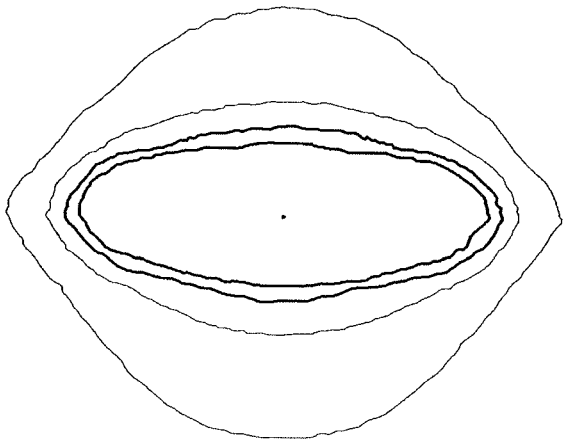

FIGS. 30 and 31 are views illustrating another example of the floodlight shown in FIGS. 26 and 27, and show an example capable of forming the intermediate light distribution type shown in FIG. 16.

Figure 32:
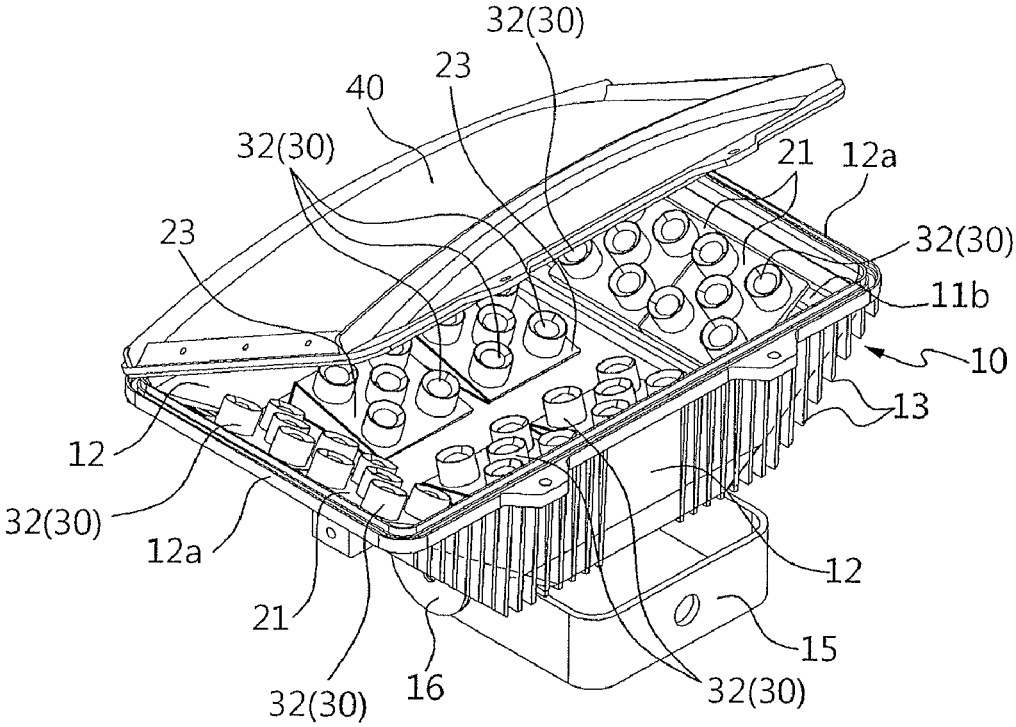
FIGS. 32 and 33 are views illustrating still another example of the floodlight shown FIGS. 26 and 27.
Figure 33:
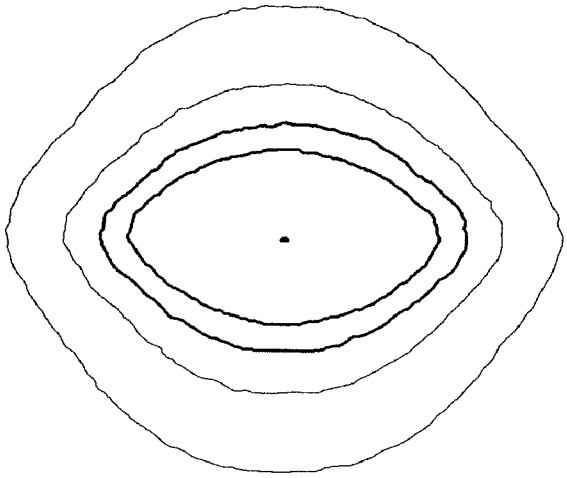

FIGS. 32 and 33 are views illustrating still another example of the floodlight shown in FIGS. 26 and 27, and show an example capable of forming the wide light distribution type shown in FIG. 16.

Figure 34:
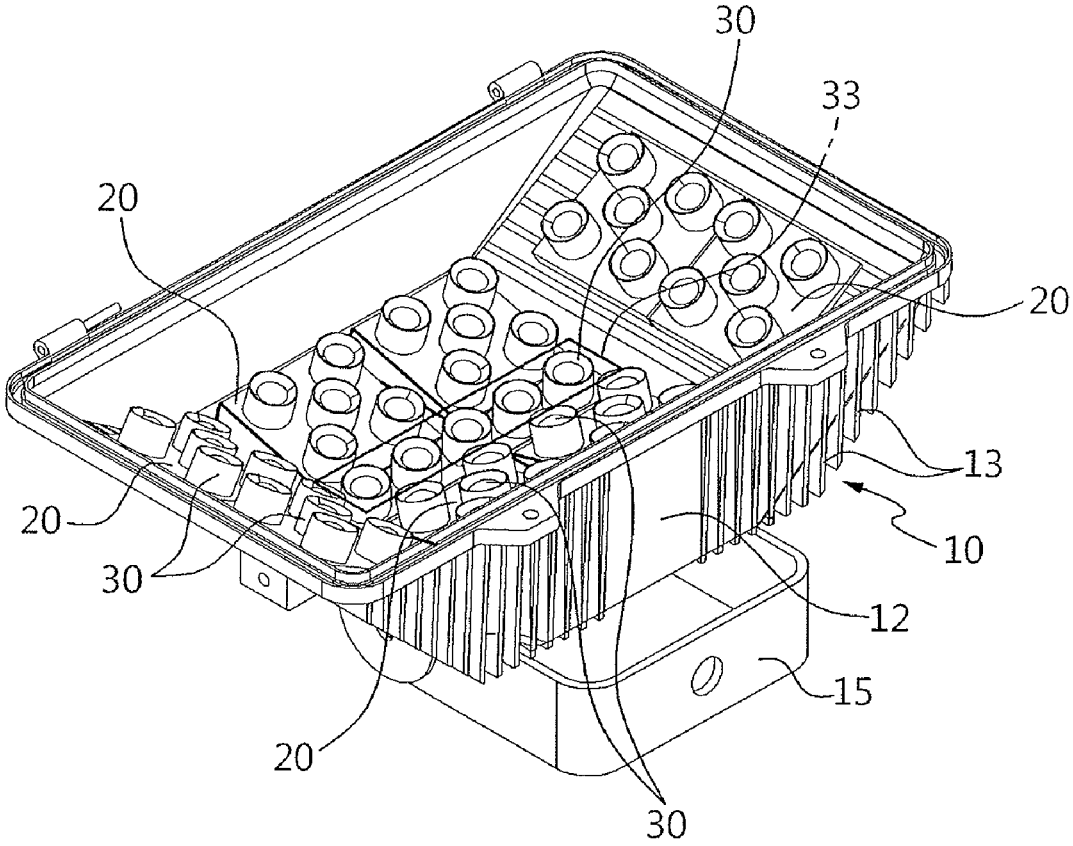
FIG. 34 is a perspective view illustrating another embodiment of the invention.

FIG. 34 is a perspective view illustrating another embodiment of the invention, and shows an example in which an auxiliary light emitting unit including a plurality of light emitting diodes is provided in an empty space of the inclined block member.

Hereinafter, as shown in FIGS. 3 to 7, a base body member 10 of the invention includes on one surface thereof a mounting surface 11 on which inclined block members 20 are mounted. In the invention, the mounting surface 11 is basically formed on the upper surface of the base body member 10.

The inclined block members 20 each provided with an inclined surface are mounted on the mounting surface 11 of the base body member 10.

A plurality of light emitting diodes module members 30 are mounted on the inclined surface of each of the inclined block members 20, and the light emitting diode module member 30 includes a light emitting diode chip (LED chip) that is mounted to a metal printed circuit board (PCB) and supplied with electric power to emit light, and a lens unit that focuses light emitted from the light emitting diode chip.

The lens unit of the light emitting diode module member 30 concentrates the light emitted from the light emitting diode chip and thus adjusts the emission range of light. The lenses are sorted into a 12° lens, a 25° lens, a 30° lens, and a 45° lens depending on the light emission range, which is well known in the art and thus a detailed description thereof will be omitted.

That is, the light emitting diode module members 30 are used separately according to the lens unit which adjusts the emission range of light at an arbitrary angle.

Figure 3:
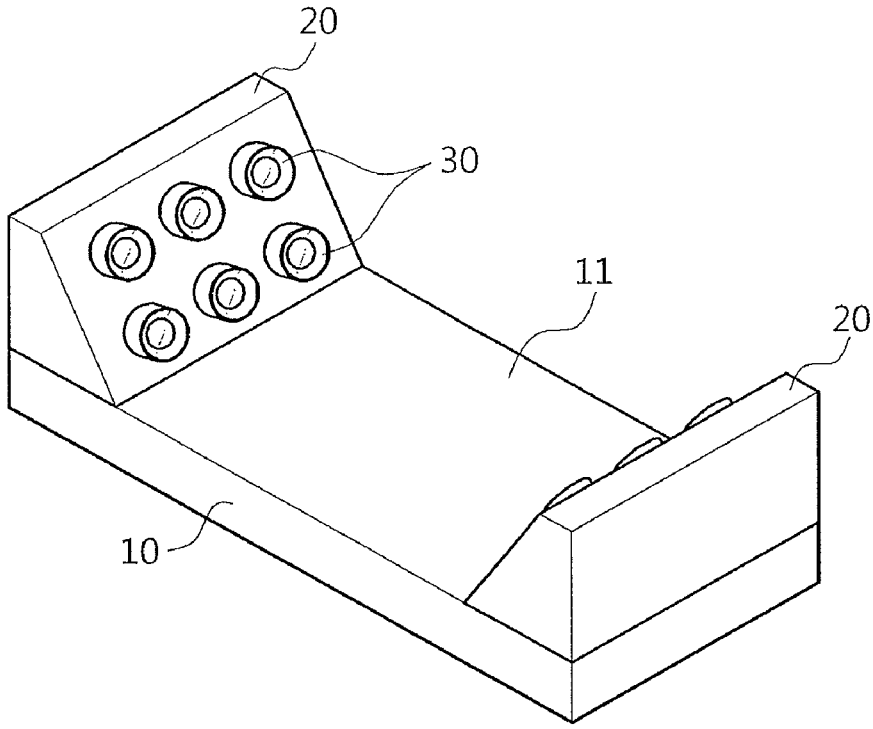
FIGS. 3 to 7 are perspective views illustrating embodiments of the invention.
Figure 4:
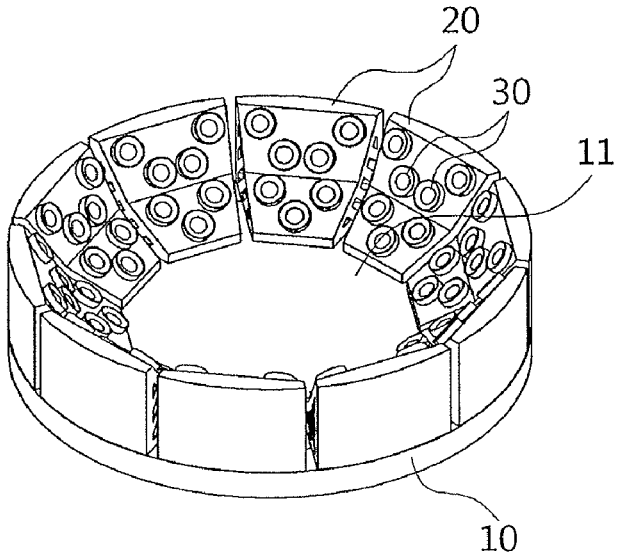

Meanwhile, the base body member 10, as shown in FIGS. 3 and 4, may be formed to have the flat mounting surface 11 having a rectangular or circular shape, and the inclined block members 20 may be mounted on the mounting surface 11.

Figure 5:
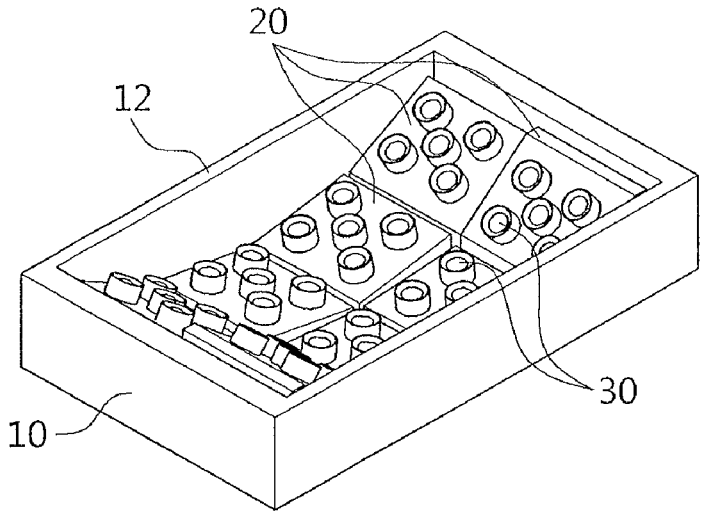
Figure 6:
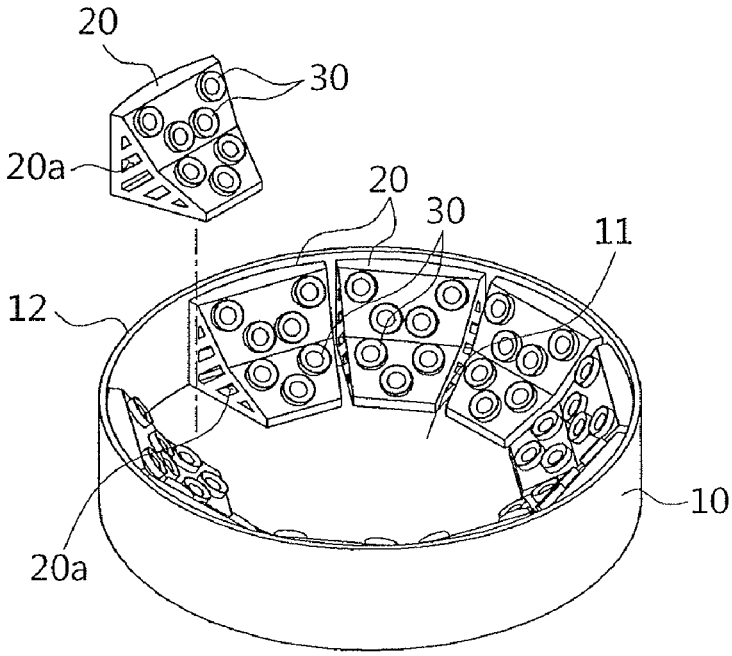
Figure 7:
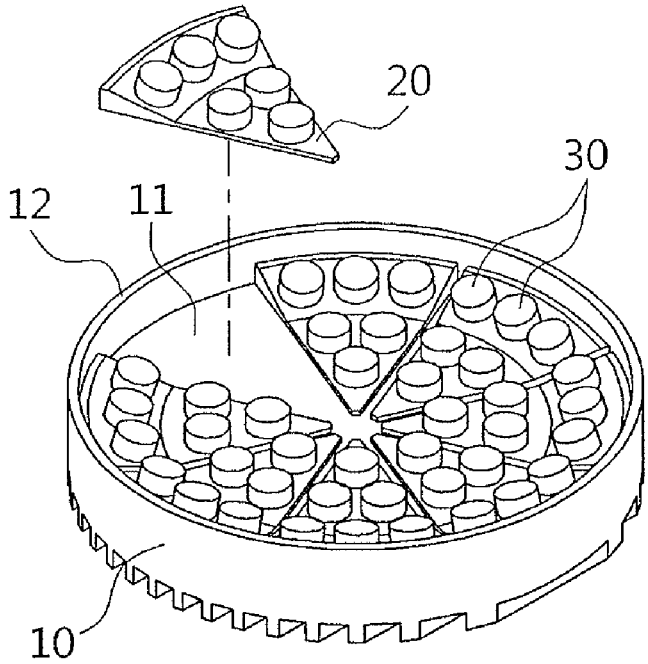
Figure 8:
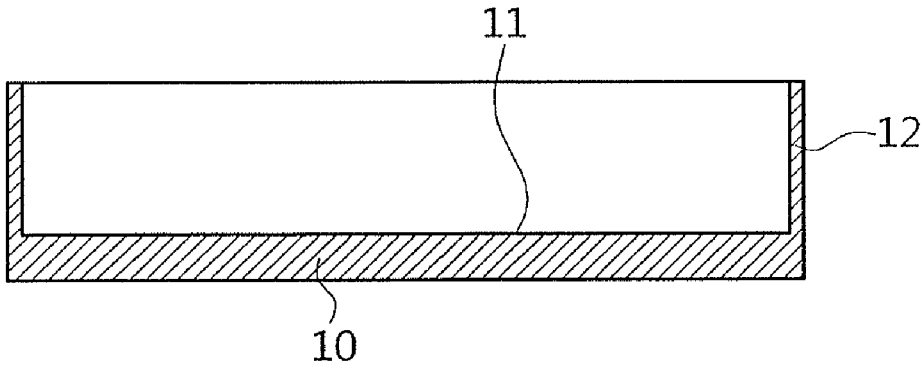
FIGS. 8 to 11 are cross-sectional views illustrating examples of a base body member of the invention.

The base body member 10 has the flat mounting surface 11 having a rectangular or circular shape, as shown in FIGS. 5 to 7, and it may be provided with a side portion 12 protruding along the outer circumference of the mounting surface 11.

Figure 9:
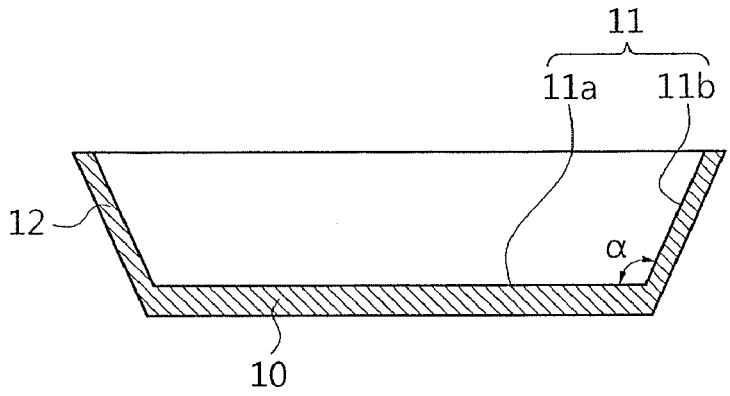

Furthermore, the side portion 12 may be formed to protrude perpendicularly along the outer circumference of the mounting surface 11, with an arbitrary height, as shown in FIGS. 5 to 7 and FIG. 8. In addition, as shown in FIG. 9, the side portion 12 may protrude so as to be inclined at an obtuse angle ($\alpha$) relative to the flat mounting surface 11 of the base body member 10, and have an inclined mounting surface 11*b* on the inside of the side portions 12 and a flat mounting surface 11*a* between the side portions 12.

The mounting surface 11 of the base body member 10 includes the flat mounting surface 11*a* and the inclined mounting surfaces 11*b* provided at both sides of the flat mounting surface 11*a*.

Figure 10:
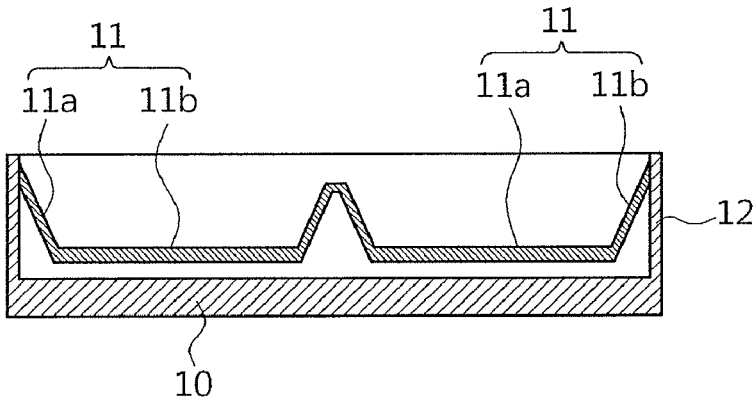
Figure 11:
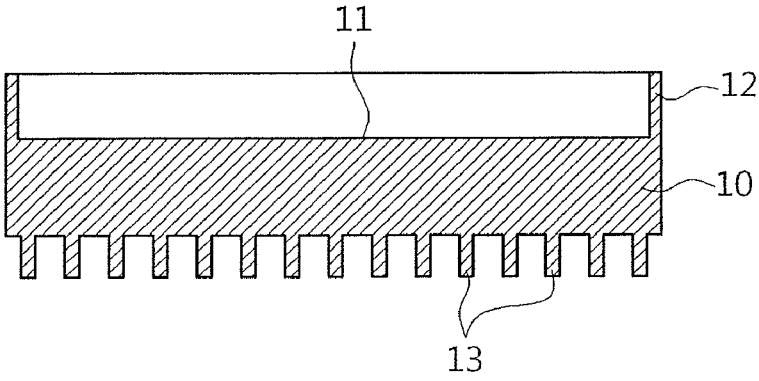

Additionally, the base body member 10, as shown in FIG. 10, may be provided with the flat mounting surfaces 11*a* between the side portions 12 vertically erected and the inclined mounting surface 11*b* provided at both sides of each of the flat mounting surfaces 11*a*. The flat mounting surface

11*a* and the inclined mounting surface 11*b* may be provided to form a pair that is symmetric with respect to the center of the base body member.

The base body member 10, as shown in FIGS. 7 to 11, preferably has at the lower part thereof a heat sink 13 for increasing a heat exchange area in order to dissipate heat.

The heat sink 13 includes a plurality of radiation fins or radiation pieces protruding from the lower surface at predetermined intervals so that a heat exchange area is increased to dissipate the heat generated from the light emitting diode modules.

The heat sink 13 is provided to dissipate heat generated from the light emitting diode chip when the light emitting diode modules emit light, and heat generated from a driver (not shown) when converting an electric power voltage supplied to the light emitting diode chip into a voltage for the chip. In this way, the heat sink 13 prevents the light emitting diode chip from being out of order due to heat.

Meanwhile, the inclined block member 20 may be formed to have a single inclined surface or a plurality of inclined surfaces, as shown in FIGS. 12 and 13.

FIG. 12 shows an example of the inclined block member 20 having a single inclined surface. In FIG. 12, (a) shows a 5° block 21 having a 5° inclined surface, (b) shows a 10° block 22 having a 10° inclined surface, (c) shows a 15° block 23 having a 15° inclined surface, and (d) shows a 40° block 25 having a 40° inclined surface.

The inclined block members 20 with a small inclination angle of 0 to 20°, as shown in (a) to (c) of FIG. 12, are mainly mounted between the flat inclination surface 11*a* and the inclined mounting surface 11*b*.

The inclined block members 20 with a large inclination angle that is equal to or greater than 30°, as shown in (d) of FIG. 12, are mainly mounted closely on the end surface of the inclination surface 11 or the inner surface of the side portion 12 vertically erected.

FIG. 13 shows examples of the inclined block member 20 with a plurality of inclined surfaces. In FIG. 13, (a) and (b) show examples of the inclined block member 20 with a pair of inclined surfaces in symmetry. In FIG. 13, (a) shows the block member mainly used in close contact with the inner surface of the side portion 12 on the base body member 10 provided with the side portion 12 vertically erected, and (b) shows the block member mounted to the inner inclined mounting surface 11*b* of the side portion 12 that is inclined at an arbitrary angle in the base body member 10.

In FIG. 13, (c) and (d) show examples of the inclined block members 20 provided with two inclined surfaces having different inclination angles. In FIG. 13, (c) shows the block member mainly used in close contact with the inner surface of the side portion 12 on the base body member 10 provided with the side portion 12 vertically erected, and (d) shows the block member mounted on the inner inclined mounting surface 11*b* of the side portion 12 that is inclined at an arbitrary angle in the base body member 10.

The inclined block member 20, as shown in (d) of FIG. 12, is preferably provided with hollow portions 20*a* to decrease the weight thereof, thereby reducing the weight of a lighting apparatus fabricated according to the invention.

The inclined block member 20, as shown in FIGS. 14 and 15, is mounted detachably to the mounting surface 11 of the base body member 10 and thus it can be replaced with another on the same base body member 10.

In addition, a pair of a mounting protrusion 20*b* and a connection groove 20*c* are provided on the mounting surface 11 of the base body member 10 and in the lower surface of the inclined block member 20, respectively, and are fitted to each other. In this way, the inclined block member is connected detachably to the mounting surface 11.

As shown in FIG. 14, the mounting protrusion 20*b* may protrude from the mounting surface of the base body member at the mounting position of the inclined block member 20, and the connection groove 20*c* may be formed in the lower surface of the inclined block member 20 at a position corresponding to the mounting protrusion 20*b*.

Furthermore, as shown in FIG. 15, the mounting protrusion 20*b* may protrude from the lower surface of the inclined block member 20, and the connection groove 20*c* may be formed in the mounting surface of the base body member at a position corresponding to the mounting protrusion 20*b*.

That is, the inclined block members 20 are sorted according to the inclination angle of the inclined surface and a plurality of light emitting diode modules mounted on the inclined surface. If necessary, the inclined block members may be replaced with others on the mounting surface 11 of the base body member 10, and thus various light distributions can be formed by a plurality of combinations of the light emitting diode modules mounted on the mounting surface 11.

Meanwhile, the embodiments of the invention will be described below, which are applied to a floodlight. However, the invention is not limited thereto, rather it may apply to any lighting apparatus designed to have a proper light distribution pattern for efficiently lighting an object to be lighted.

FIG. 16 is a schematic view illustrating light distribution types typically used in a floodlight, that is, a narrow light distribution type, an intermediate light distribution type, and a wide light distribution type.

In FIG. 16, (a) shows a narrow light distribution type having a small width and a long length, (b) shows an intermediate light distribution type having a width larger than the narrow light distribution type, and (c) shows a wide light distribution type having a width larger than the intermediate light distribution type. The embodiments for forming the above three types of light distributions are as follows.

Here, the inclined block members 20 used in the following embodiments includes a 5° block 21 that is inclined at an angle of 5°, a 10° block 22 that is inclined at an angle of 10°, a 15° block 23 that is inclined at an angle of 15°, a 30° block that is inclined at an angle of 30°, and a 40° block 25 that is inclined at an angle of 40° with respect to the flat mounting surface 11.

The light emitting diode module member 30 used in the following embodiments includes a first light emitting diode module 31 provided with a 12° lens and a second light emitting diode module 32 provided with a 30° lens.

First Embodiment

The first embodiment forms a narrow light distribution type using the base body member 10 having a rectangular box shape with its upper surface being opened, which includes the rectangular mounting surface 11 and the side portion 12 that protrudes vertically from the edge of the mounting surface 11 with a predetermined height, as shown in FIG. 17.

In this embodiment, the lengthwise direction of the rectangular mounting surface 11 is the horizontal direction and the widthwise direction thereof is the vertical direction.

The inclined block members 20 in the first embodiment, as shown in FIG. 18, are arranged in two rows in the lengthwise direction of the mounting surface 11, and the first row includes two 5° blocks 21 mounted at the center of the mounting surface 11 so as to face each other in the lengthwise direction thereof and a pair of 40° blocks 25 mounted at the outsides of the 5° blocks 21 so as to face each other in the widthwise direction.

The second row includes a pair of 10° blocks 22 mounted at the center of the mounting surface 11 so as to face each other in the lengthwise direction and a pair of 30° blocks 24 mounted at the outsides of the 10° blocks 22 so as to face each other in the lengthwise direction.

Furthermore, five first light emitting diode modules 31 each having a 12° lens are mounted on each of the inclined block members 20.

This embodiment forms the light distribution type shown in (a) of FIG. 16, which has a narrow width and a long length as shown in FIG. 19.

Second Embodiment

The second embodiment forms an intermediate light distribution type using the base body member 10 having a rectangular box shape with its upper surface being opened, which includes the rectangular mounting surface 11 and the side portion 12 that protrudes vertically from the edge of the mounting surface 11 with a predetermined height, as shown in FIG. 20.

In this embodiment, the lengthwise direction of the rectangular mounting surface 11 is the horizontal direction and the widthwise direction thereof is the vertical direction.

The inclined block members 20 in the second embodiment, as shown in FIG. 20, include two pairs of 5° blocks 21 mounted at the center of the mounting surface 11 so as to face each other in the widthwise direction thereof and a pair of 30° blocks 24 mounted at the outsides of the 5° blocks 21 so as to face each other in the lengthwise direction of the mounting surface 11.

Five second light emitting diode modules 32 each provided with a 30° lens are mounted to each of the 5° blocks 21, and upper and lower rows of six light emitting diode module members 30 are mounted to the 30° blocks 24. The upper row 32*a* include six second light emitting diode modules 32 each provided with a 30° lens, and the lower row 31*a* include six first light emitting diode modules 31 each provided with a 12° lens.

This embodiment forms the intermediate light distribution type shown in (b) of FIG. 16, which has a width larger than the first embodiment, as shown in FIG. 22.

Third Embodiment

The third embodiment forms an intermediate light distribution type using the base body member 10 having a rectangular box shape with its upper surface being opened, which includes the rectangular mounting surface 11 and the side portion 12 that protrudes vertically from the edge of the mounting surface 11 with a predetermined height, as shown in FIG. 23.

In this embodiment, the lengthwise direction of the rectangular mounting surface 11 is the horizontal direction and the widthwise direction thereof is the vertical direction.

The inclined block members 20 in the third embodiment, as shown in FIG. 24, include two pairs of 15° blocks 23 mounted at the center of the mounting surface 11 so as to face each other in the widthwise direction thereof and a pair of 30° blocks 24 mounted at the outsides of the 15° blocks 23 so as to face each other in the lengthwise direction of the mounting surface 11.

Five second light emitting diode modules 32 each provided with a 30° lens are mounted to each of the 15° blocks 23, and upper and lower rows of six light emitting diode module members 30 are mounted to the 30° blocks 24. The upper row 32*a* include six second light emitting diode modules 32 each provided with a 30° lens, and the lower row 31*a* include six first light emitting diode modules 31 each provided with a 12° lens.

This embodiment forms the wide light distribution type shown in (c) of FIG. 16, which has a width larger than the second embodiment, as shown in FIG. 25.

Meanwhile, in the following fourth to sixth embodiments, the base body member 10, as shown in FIGS. 26 and 27, is formed in a rectangular box shape having the mounting surface 11 of a rectangular shape and the side portion 12 protruding vertically from the edge of the mounting surface 11 at a predetermined height, with an upper surface thereof opened. They relate to floodlights which use the base body member 10 in which both side portions 12 in the lengthwise direction thereof are symmetrically inclined, which are capable of combining the inclined block members 20 on one base body member 10 to various light distribution types used in the flood light, such as the narrow light distribution, the intermediate light distribution type, and the wide light distribution type.

The two side portions 12*a* in the lengthwise direction are inclined basically at 35° relative to a line extending from the flat mounting surface 11*a* of the base body member 10.

Further, the mounting surface 11 to which the inclined block members 20 are mounted is provided inside the base body member 10. The mounting surface 11 includes inclined mounting surfaces 11*a* on the inner surfaces of the side portions 12*a* in the lengthwise direction, which are inclined at the same angle as the side portions 12*a* in the lengthwise direction, and a flat mounting surface 11*a* provided between the inclined mounting surfaces 11*b*.

In addition, a transparent panel member 40 is preferably provided on the upper opened part of the base body member 10 for covering it to protect the light emitting diode module members 30, and to prevent a foreign substance from getting thereinto.

The transparent panel member 40 is made of glass, or transparent or opaque synthetic resin to transmit light emitted from the light emitting diode module members 30.

A first cover connection portion 14 having fastening holes 14*a* for bolt fastening at both sides of the upper parts thereof is provided in the side portion 12 of the base body member 10, and a second cover connection part 41 having bolt fastening holes 41*a* for bolt fastening, which correspond to the fastening holes 14*a* is provided in the transparent panel 40.

The transparent panel member 40 is connected to the upper part of the base body member 10 and then the first and second connection parts 14 and 41 are aligned to be fastened with bolts 42. When releasing the fastening bolt, they are separated from each other.

The transparent panel member 40 may be connected detachably to the base body member 10 by other ways, except for the aforementioned way. If necessary, it may be separated to open the inside of the base body member 10 for replacing and monitoring the light emitting diode modules 30.

A hit sink 13 for dissipating heat is provided on the outer side of the base body member 10.

A hinge part 16, which is hinged rotatably to a fixing member 15 that is to be fixed at an arbitrary position, is provided on the lower part of the base body member 10 so that a mounting angle can be adjusted.

Fourth Embodiment

This embodiment is an example of a floodlight using the base body member 10 in which two side portions 12*a* in the lengthwise direction are inclined 35°, as shown in FIG. 28, thereby forming the narrow light distribution type shown in (a) of FIG. 16.

Further, the inclined mounting surfaces 11*b* on which the inclined block members 20 are mounted are provided on the inner surfaces of two side portions 12*a* of the base body member 10 in the lengthwise direction.

The flat mounting surface 11*a* is provided between the inclined mounting surfaces 11*b* inside the base body member 10.

Two symmetrical pairs of 5° blocks 21 are mounted on the inclined mounting surfaces 11*b*. One pair of 5° blocks 21 are mounted such that the inclination angle thereof is increased 5° and the other pair of 5° blocks 21 are mounted such that the inclination angle thereof is decreased 5°, relative to the reference line of the inclined mounting surface 11*b*.

That is, one pair of 5° blocks 21 is mounted such that the higher part faces the upper part in the inclined mounting surface 11*b*. Therefore, the angle between a straight line extending from the flat mounting surface 11*a* and the reference line is increased 5°. The other pair of 5 blocks is mounted such that the higher part faces the lower part in the inclined mounting surface 11*a*. Therefore, the angle between a straight line extending from the flat mounting surface 11*a* and the reference line is decreased 5°.

Here, two pairs of 10° blocks 22 are mounted on the flat mounting surface 11*a* such that the inclined surfaces thereof face each other in the lengthwise direction.

Five first light emitting diode modules 31 each provided with a 12° lens are provided on each of the inclined block members 20, that is, each of the two pairs of 5° blocks 21 and the two pairs of 10° blocks 22.

This embodiment forms the narrow light distribution type shown in (a) of FIG. 16, which has a narrow width and a long length, as shown in FIG. 29.

Fifth Embodiment

This embodiment is an example of a floodlight using the base body member 10 in which two side portions 12*a* in the lengthwise direction are inclined 35°, as shown in FIG. 30, thereby forming the intermediate light distribution type shown in (b) of FIG. 16.

Further, the inclined mounting surfaces 11*b* on which the inclined block members 20 are mounted are provided on the inner surfaces of two side portions 12*a* in the lengthwise direction inside the base body member 10.

The flat mounting surface 11*a* is provided between the inclined mounting surfaces 11*b* inside the base body member 10.

Two symmetrical pairs of 5° blocks 21 are mounted on the inclined mounting surfaces 11*b* such that the inclination angle thereof is decreased 5°, relative to a reference line of the inclined mounting surface 11*b*.

That is, the two pairs of 5° blocks 21 are mounted such that the higher part faces the lower part of the inclined mounting surface 11*b*. Therefore, the angle between a straight line extending from the flat mounting surface 11*a* and the reference line is decreased 5°.

Two pairs of 5° blocks are mounted on the flat mounting surface 11*a* such that the inclined surfaces thereof face each other in the vertical direction.

Five light emitting diode module members 30 are mounted on each of the inclined block members 20, that is, eight 5° blocks 21. Among two pairs of 5° blocks mounted to the inclined mounting surfaces 11*b*, only the first light emitting diode modules 31*a* in the lowest row, that is, the range indicated by "A" in FIG. 30 each have a 12° lens, and the second light emitting diode modules 32 in the other range each have a 30° lens.

This embodiment forms the intermediate light distribution type shown in (b) of FIG. 16, which has a width smaller than the fourth embodiment, as shown in FIG. 31.

Sixth Embodiment

This embodiment is an example of a floodlight using the base body member 10 in which two side portions 12*a* in the lengthwise direction are inclined 35°, as shown in FIG. 32, thereby forming the wide light distribution type shown in (c) of FIG. 16.

The inclined mounting surfaces 11*b* on which the inclined block members 20 are mounted are provided on the inner surfaces of two side portions 12*a* in the lengthwise direction inside the base body member 10.

The flat mounting surface 11*a* is provided between the inclined mounting surfaces 11*b* inside the base body member 10.

Two symmetrical pairs of 5° blocks 21 are mounted on the inclined mounting surfaces 11*b* such that the inclination angle thereof is decreased 5°, relative to a reference line of the inclined mounting surface 11*b*.

That is, the two pairs of 5° blocks 21 are mounted such that the higher part faces the lower part of the inclined mounting surface 11*b*. Therefore the angle between a straight line extending from the flat mounting surface 11*a* and the reference line is decreased 5°.

Two pairs of 15° blocks are mounted on the flat mounting surface 11*a* such that the inclined surfaces thereof face each other in the vertical direction.

Five second light emitting diode modules 32 each provided with a 30° lens are mounted on each of the inclined block members 20, that is, the two pairs of 5° blocks 21 and the two pairs of 15° blocks 23.

This embodiment forms the wide light distribution type shown in (c) of FIG. 16, which has a width larger than the fifth embodiment, as shown in FIG. 33.

Meanwhile, an auxiliary light emitting unit 33 including a plurality of light emitting modules 30 may be provided between the inclined block members 20 on the mounting surface 11 of the base body member 10, as shown in FIG. 34, in order to increase the quantity of light.

As described above, according to the invention, it is possible to easily obtain various light distributions required for the lighting design by combining the inclined block members 20 and the light emitting diode module members 30 that are mounted on the mounting surfaces of the base body member 10.

In the above-described embodiments, the base body member 10 has a rectangular shape that is suitable for forming light distribution that is used mainly in a floodlight and replacing the inclined block members 20.

The invention is not limit to the above-described embodiments and various changes or modifications can be made without departing from the scope of the invention, and it is evident that they are included in the constitution of the invention.

The invention is used basically for a floodlight, as described above, and it is clear that it can be used for various light distributions.

The invention claimed is:

1. A lighting apparatus using light emitting diodes, comprising:

a base body member comprising a mounting portion and a side portion protruding toward the outer circumference of the mounting portion, the mounting portion having a pair of horizontal sides and a pair of vertical sides, which are shorter than the horizontal sides;

a plurality of inclined block members detachably mounted on the mounting portion inside the base body member, each inclined block member having inclined surfaces; and light emitting diode module members that are mounted on the inclined surfaces of the inclined block members, wherein the inclined block members comprise a pair of first inclined blocks whose inclined surfaces are opposed to each other and a pair of second inclined blocks whose inclined surfaces are opposed to each other, wherein the pair of second inclined blocks is interposed between the pair of first inclined blocks.

2. The lighting apparatus using light emitting diodes according to claim 1, wherein the base body member is formed such that the side portions facing each other are inclined at a predetermined angle.

3. The lighting apparatus using light emitting diodes according to claim 1, wherein the mounting portion of the base body member comprises a flat mounting portion and inclined mounting portions which are opposed to each other and provided at both sides of the flat mounting surface.

4. The lighting apparatus using light emitting diodes according to claim 1, wherein a heat sink for dissipating heat is provided at an outer surface of the mounting portion and the side portion of the base body member.

5. The lighting apparatus using light emitting diodes according to claim 1, wherein a transparent panel member that covers an inner part of the base body member, and the transparent panel member detachably mounted to an upper part of the side portion of the base body member.

6. The lighting apparatus using light emitting diodes according to claim 1, wherein each inclined block member has a plurality of inclined surfaces.

7. The lighting apparatus using light emitting diodes according to claim 1, wherein each inclined block member has hollow parts.

8. The lighting apparatus using light emitting diodes according to claim 1, wherein the base body member, the inclined block members, and the light emitting diode module members are used as a floodlight.

* * * * *